US008636434B2

(12) United States Patent
Tranchant et al.

(10) Patent No.: US 8,636,434 B2
(45) Date of Patent: Jan. 28, 2014

(54) CONTAINER, A DEVICE INCLUDING SUCH A CONTAINER, THE USE OF SUCH A DEVICE, AND A METHOD OF APPLYING A COMPOSITION ON THE NAILS

(75) Inventors: Jean-Francois Tranchant, Marigny-les-Usages (FR); Marc Chevalier, Francoville (FR); Julie Epis, Fublaines (FR); Morgane Sarthou, Livry Gargan (FR)

(73) Assignee: L V M H Recherche, Saint Jean de Braye (FR)

( * ) Notice: Subject to any disclaimer, the term of this patent is extended or adjusted under 35 U.S.C. 154(b) by 102 days.

(21) Appl. No.: 12/814,911

(22) Filed: Jun. 14, 2010

(65) Prior Publication Data

US 2011/0180089 A1 Jul. 28, 2011

(51) Int. Cl.
*A46B 11/00* (2006.01)

(52) U.S. Cl.
USPC ..... 401/129

(58) Field of Classification Search
USPC ..... 401/6, 48, 118, 124, 126–219
See application file for complete search history.

(56) References Cited

U.S. PATENT DOCUMENTS

| | | | | | |
|---|---|---|---|---|---|
| 2,656,842 | A | | 10/1953 | Ammarell | |
| D183,335 | S | * | 8/1958 | Weckesser | D9/502 |
| 2,865,384 | A | | 12/1958 | Noon | |
| D349,045 | S | * | 7/1994 | Schmitt | D9/692 |
| 5,567,070 | A | | 10/1996 | Ficcadenti | |
| D439,010 | S | * | 3/2001 | Sogaro | D28/7 |
| D474,341 | S | * | 5/2003 | Cantone et al. | D4/116 |
| D484,810 | S | * | 1/2004 | Rosen | D9/559 |
| D548,108 | S | * | 8/2007 | Lo | D9/719 |

FOREIGN PATENT DOCUMENTS

| | | |
|---|---|---|
| DE | 91 04 931.1 | 4/1991 |
| DE | 299 10 184 | 6/1999 |
| EP | 0 677 258 | 10/1995 |
| EP | 1 421 874 | 5/2004 |
| WO | WO-98/31252 | 7/1998 |

OTHER PUBLICATIONS

International Search Report and Written Opinion from related French Application No. FR 10 50516; report dated Nov. 4, 2010.

* cited by examiner

*Primary Examiner* — Huyen Le
(74) *Attorney, Agent, or Firm* — Miller, Matthias & Hull LLP

(57) ABSTRACT

Container for receiving a composition, a device including such a container, a use and a method for applying the composition contained in such a container on the nails, the container comprising a side wall that extends along a central axis between a bottom and an opening, the side wall presenting a first outside constriction shaped to receive two adjacent fingers, other than the thumb, of a first hand of a user. The side wall also includes a second outside constriction shaped to receive two adjacent fingers, other than the thumb of a second hand of the same user, the second constriction being spaced apart from the first constriction along the central axis.

6 Claims, 3 Drawing Sheets

CONTAINER, A DEVICE INCLUDING SUCH A CONTAINER, THE USE OF SUCH A DEVICE, AND A METHOD OF APPLYING A COMPOSITION ON THE NAILS

CROSS-REFERENCE TO RELATED APPLICATIONS

This application is a Patent Application filing under 35 USC §119 which claims priority under the Paris Convention to French Patent Application No. 10 50516, filed on Jan. 26, 2010.

FIELD OF THE DISCLOSURE

The present invention relates to containers, to devices comprising such a container and an applicator comprising a handle and an applicator head, to the use of such a device for applying a composition contained in the container onto a surface, and also to a method of applying a composition on the nails.

More precisely, the container for receiving a composition comprises an annular side wall that extends along a central axis between a bottom and an opening, the side wall presenting a first outside constriction shaped to receive two adjacent fingers, other than the thumb, of a first hand of a user.

BACKGROUND OF THE DISCLOSURE

The container described in U.S. Pat. No. 2,656,842 is provided with a single constriction formed by two concave shoulders, each designed to receive one finger on a hand.

Nevertheless, such a container needs to be put down on a surface in order to be used.

The same applies to the container described in WO 98/31252 or in EP 1 421 874, which likewise has a single constriction shaped to receive two adjacent fingers, but which likewise needs to be put down in order to be used.

U.S. Pat. No. 5,567,070 discloses a container that does not require to be put down while it is in use.

Nevertheless, the sole constriction provided on that container is formed by two deep recesses shaped so that they cover about three-quarters of the peripheries of the fingers that are received therein. Removing the fingers received in that constriction is thus rather laborious and the user runs the risk of damaging the coated surfaces, in particular when applying composition to the nails, e.g. a nail varnish.

Furthermore, none of those previously-known containers is suitable for passing from one hand to the other without being put down, without risk of damage to the coated surfaces and without risk of overthrowing.

SUMMARY OF THE DISCLOSURE

A particular object of the present invention is to make it easier to pass the container from one hand to the other, so as to enable the user to make use of the container and to pass it from one hand to the other without needing to put the container down on a support, thereby mitigating the above-mentioned drawbacks.

In particular, the present invention seeks to propose in case of a cosmetic composition a container that meets safely and effectively to the needs of users from being able to make up any time, including in transport.

To this end, according to the invention, the side wall also includes a second outside constriction shaped to receive two adjacent fingers, other than the thumb, of a second hand of the same user, the second constriction being spaced apart from the first constriction along the central axis.

By means of these dispositions, the container is made easier to use and to pass from one hand to the other since the user does not need to put the container down. Using the container and passing it from one hand to the other are easily done, since the two constrictions are provided and shaped so that each of them serves to receive the fingers of one hand; when one constriction is occupied by the fingers of one hand, then the other constriction is free to receive the fingers of the other hand of the user. The container is passed from one hand to the other by placing the fingers of the other hand in the second constriction, while the fingers of the first hand are still in position in the first constriction.

In various embodiments of the invention, recourse may optionally also be had to one and/or more of the following provisions:

- each of the first and second constrictions presents a minimum diametral width of not more than 2 centimeters (cm);
- the first and second constrictions are spaced apart from each other by at least 5 mm along the central axis;
- each of the first and second constrictions extends substantially in a transverse plane that is perpendicular to the central axis;
- each of the first and second constrictions is formed by two grooves formed respectively on either side of the container and each extending longitudinally along a longitudinal axis that is preferably perpendicular to the central axis;
- the longitudinal axes of the two grooves in each of the first and second constrictions form between them an angle lying in the range 0° to 45° inclusive;
- the longitudinal axes of the two grooves of each of the first and second constrictions define respective middle axes, the middle axes of the first and second constrictions being angularly offset from each other by an angle lying in the range 45° to 135°, and preferably in the range 45° to 120°, preferably about 45°; and
- each of the first and second constrictions forms a respective angular groove passing all the way around the side wall.

Furthermore, the invention also provides a device comprising such a container and an applicator comprising a handle and an applicator head connected to said handle, the handle and the applicator forming a cap for closing the container.

Furthermore, the invention provides the use of such a device for applying a composition contained in the container on a surface, the composition presenting viscosity at 25° C. lying in the range 5 megapascal seconds (mPa·s) to 5000 mPa·s, and preferably in the range 20 mPa·s to 4000 mPa·s. The composition contained in the container is preferably selected from coating compositions such as paints, lacquers, and varnishes, and from cosmetics such as nail varnish, lipstick, and mascaras, in particular for a use in which the surface to be coated is a region of the human body.

Furthermore, the invention also provides a method of applying a composition on the nails, the method comprising the following steps:

i) gripping the container of a device between two adjacent fingers of a first hand of a user, in the first constriction;

ii) applying the composition on at least one nail of the first hand of the user;

iii) then gripping the container between two adjacent fingers of a second hand of the same user, in the second constriction;

iv) removing the two fingers of the first hand from the first constriction; and v) applying the composition on at least one nail of the second hand.

Step ii) may be repeated as often as necessary on the same surface before moving on to step iii) and/or may be performed on all of the nails of the first hand of the user.

Furthermore, steps i) to v) may be repeated as many times as necessary, in particular if several layers are needed in order to obtain the expected results on the nails.

The user may perform an application on all of the nails of one hand before moving on to the nails of the other hand, or on the contrary, if the user prefers changing hands regularly, this can be done very easily so that it is possible to do some of the nails on one hand, then to do some of the nails on the other hand, then to return to the first hand, and so on, without needing to put the container down.

Similarly, the user may decide always to place the same fingers in the constrictions, or may prefer to change fingers, in particular to move the container closer to the fingers having the nails on which the application is being performed. Under such circumstances, and if the user prefers to finish application on the nails of one hand before passing on to the other hand, it is very easy for the user to move the container to a different position between the fingers of one hand while using the other hand to grip and hold the container temporarily for the time it takes to put the desired fingers of the first hand into place for gripping the container again.

Thus, the user may begin by gripping the container in a first hand, e.g. between the index finger and the middle finger, and applying varnish to the index and middle fingers. Thereafter, the user may grip the container using the second hand without putting the container down by placing two fingers in the second constriction, then by letting go with the first hand and subsequently positioning, for example, the middle finger and the ring finger of the first hand in the first constriction (still without putting the container down) in order to grip the container again in the first hand and release it with the second hand, and so on.

The invention can be well understood and its advantages appear more clearly on reading the following detailed description of embodiments of the invention shown as non-limiting examples.

BRIEF DESCRIPTION OF THE DRAWINGS

The description refers to the accompanying drawings, in which.

DETAILED DESCRIPTION OF THE DISCLOSURE

Figure 1:
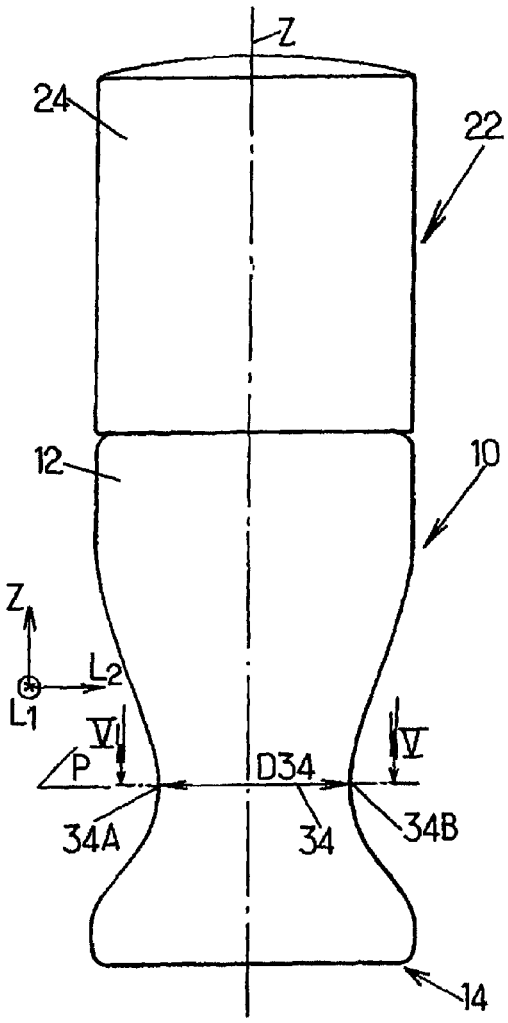
FIG. 1 is a side view of a device of the invention.

FIG. 1 shows a container 10 comprising an annular side wall 12 that extends along a central axis Z between a bottom 14 and an opening 16. More precisely, and with reference to FIG. 3, the container 10 includes a neck 18 extending along the central axis Z to a free end 18A provided with the opening 16 for passing an applicator head 20 (shown in FIG. 7). The side wall 12 extends between the bottom 14 and the neck 18.

Figure 7:
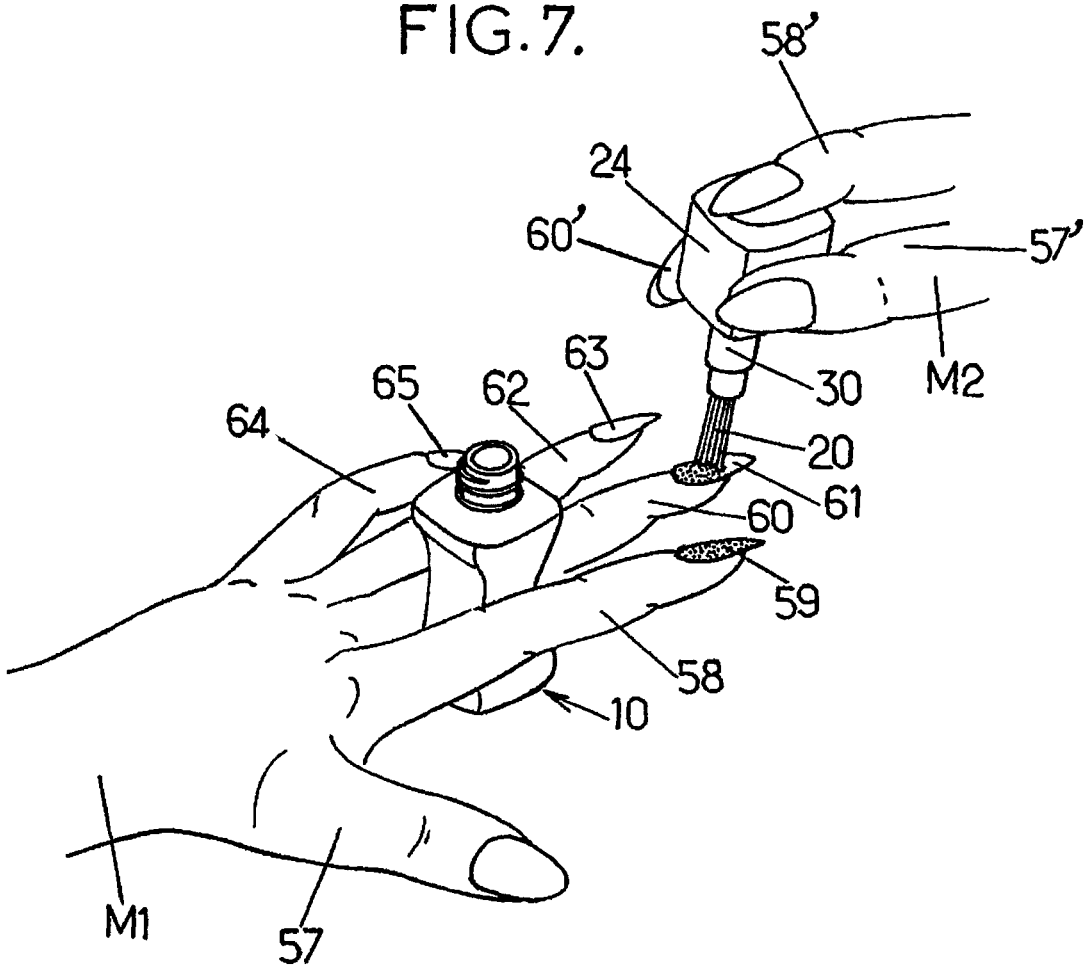
FIG. 7 is a perspective view of the FIG. 1 device in use.

With reference to FIG. 7, the device 22 comprises the container 10 and an applicator formed by a handle 24 connected to the applicator head 20, the handle 24 forming a cap for closing the container 10. Typically, and as shown more clearly in FIG. 3, the neck 18 is provided in known manner with a thread 26 and the handle 24 is provided with tapping (not shown) so that the handle 24 can be fastened on the container 10, forming a cap therefor.

The applicator head 20 is advantageously fastened to the handle 24 by means of a stem 30 that extends preferably along the central axis Z when the handle 24 is fastened to the container 10.

Figure 3:
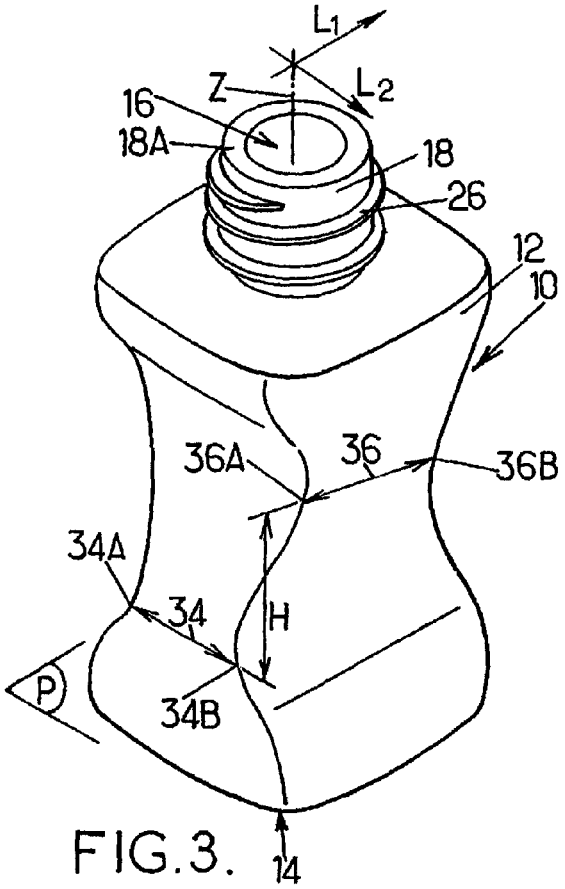
FIG. 3 is a perspective view of the container of the FIG. 1 device.

In order to enable the user to apply the composition 32 contained in the container 10 while holding the container, without needing to put it down on a surface, while keeping hold of it in one hand only, and while holding the applicator head 20 via its handle 24 in the other hand, the annular side wall 12 of the container 10 presents an outside constriction 34 shaped to receive two adjacent fingers, other than the thumb 57, of a first hand M1, as shown in FIGS. 1 and 3. Throughout the description below, the term "composition" is used to mean a fluid or liquid that is viscous to a greater or lesser extent.

Figure 2:
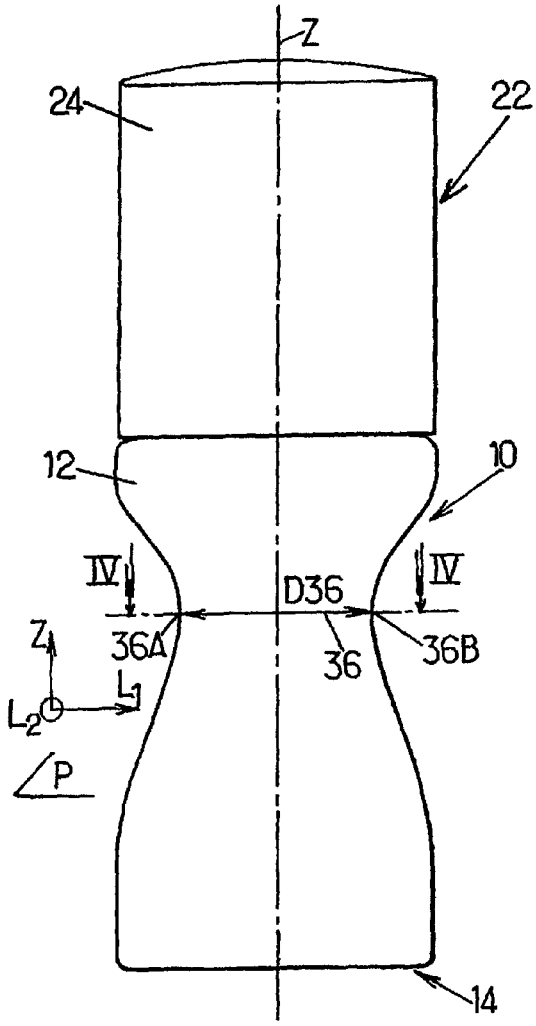
FIG. 2 is a view of another side of the FIG. 1 device.

In order to make it easy to change the container 10 from one hand to the other without it being necessary to put the container down, the side wall 12 includes a second outside constriction 36, likewise shaped to receive two adjacent fingers (other than the thumb 57') of a second hand M2 of a user, as shown more clearly in FIGS. 2 and 3.

Each of the first and second constrictions 34 and 36 preferably presents a respective minimum diametral width D34 or D36 that is no greater than 2 cm. The diametral width D34 crosses the central axis Z and is measured on the outside of the side wall 12 in the constriction 34. The diametral width D36 is defined analogously for the constriction 36.

Figure 4:
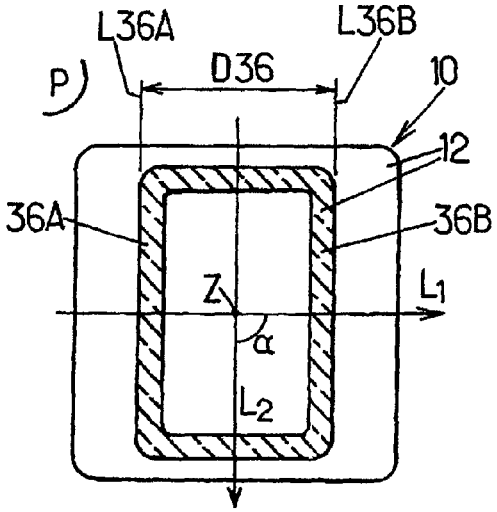
FIG. 4 is a section view of the FIG. 2 device on line IV-IV.
Figure 5:
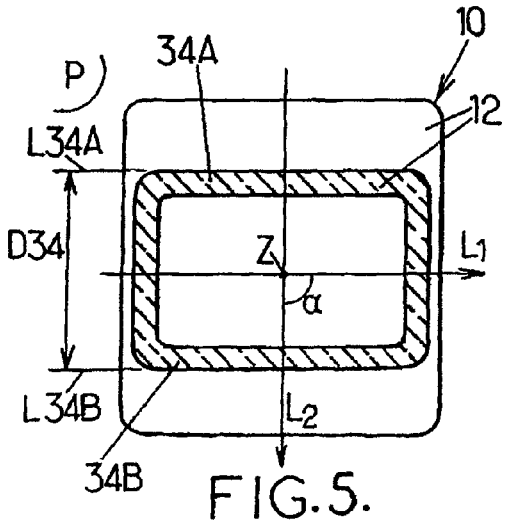
FIG. 5 is a section view of the FIG. 1 device on line V-V.

With reference to FIGS. 4 and 5, correspondingly respectively to a section on IV-IV of the second constriction and a section of V-V of the first constriction 34, as shown in FIGS. 2 and 1, each of the first and second constrictions 34 and 36 preferably extends in a transverse plane P perpendicular to the central axis Z.

Each of the first and second constrictions 34 and 36 is preferably formed by two grooves, respectively 34A & 34B and 36A & 36B, that are formed on either side of the container 10, each extending longitudinally along a respective longitudinal axis L34A, L34B for the first constriction 34, and along a respective longitudinal axis L36A, L36B for the second constriction 36, perpendicularly to the central axis Z.

The longitudinal axes L34A and L34B of the first constriction 34 and the longitudinal axes L36A and L36B of the second constriction 36 define a respective middle axis L1, L2 which middle axes are preferably angularly offset relative to each other by an angle $\alpha$.

Specifically, with a container 10 of quadrilateral section, the angle $\alpha$ is substantially equal to 90°, such that the four grooves 34A, 34B, 36A, and 36B are advantageously formed in respective ones of the four sides forming the container.

When the container is not of quadrilateral section, and in particular when it is of an axially symmetrical cylindrical shape or of some more complex shape, the angle $\alpha$ between the middle axis L1 of the first constriction 34 and the middle axis L2 of the second constriction 36 may be less than 90°, and is preferably about 45° so as to make it easier to pass the container 10 from one hand to the other. The container may be of more complex shape, for example it may be somewhat twisted, in which the case the angle $\alpha$ may have some other value, but it preferably lies in the range 45° to 135°, and preferably in the range 45° to 120°.

The container 10 may be made of a polyamide material, such as for example a polyamide copolymer such as Nylon® sold by the supplier EMS under the name "Grivory®", in particular the "Grivory® G21".

The two grooves 34A & 34B and 36A & 36B respectively of the first and second constrictions 34 and 36 may either be parallel, forming an angle that is substantially zero between each other, as shown in the figures. Alternatively, the angle measured between the longitudinal axes L34A and L34B of the first constriction 34, and likewise the angle measured between the longitudinal axes L36A and L36B of the second constriction 36, may be non-zero, in which case the grooves are no longer mutually parallel within a given constriction, and they may flare relative to each other by an angle lying in the range zero to 40°.

Figure 6:
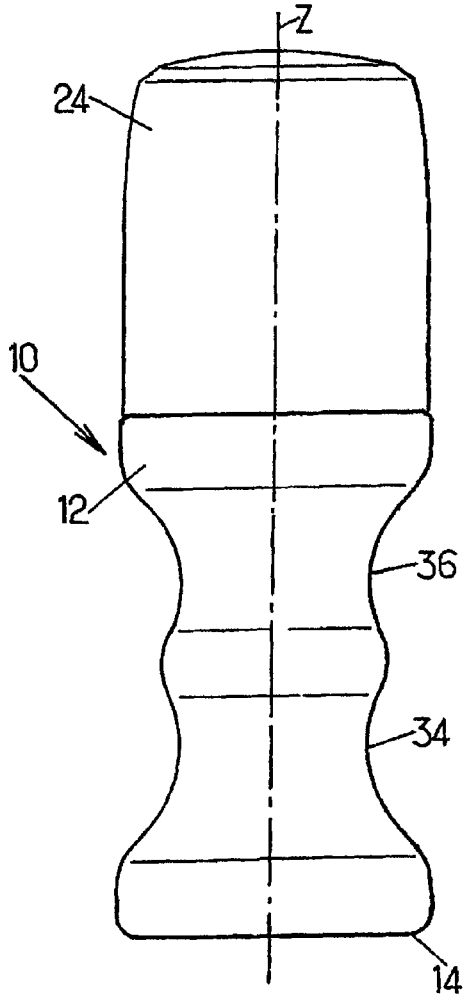
FIG. 6 is a side view of a device constituting another variant.

Furthermore, and in particular when the container 10 is cylindrical and axially symmetrical about the central axis Z, the first and second constrictions 34 and 36 respectively preferably form respective annular grooves all the way round the side wall 12, as shown in FIG. 6.

In order to facilitate passing the container 10 from one hand to the other, the first and second constrictions 34 and 36 are preferably spaced apart from each other vertically along the central axis. Specifically, as shown in the figures, the height H between the first and second constrictions 34 and 36 is preferably of the order of 5 mm along the central axis Z.

Depending on the nature of the composition 32 contained in the container 10, the applicator head 20 may be in the form of a paint brush or of any other type of applicator, with or without bristles, which may be rigid or flexible, etc.

The container 10 of the device 22 of the invention is intended more particularly for containing a liquid composition 32 that is viscous to a greater or lesser extent and that is suitable for application to a surface. The use of such a device of the invention is particularly advantageous when the container 10 contains a composition selected from coatings (more particularly for do-it-yourself (DIY)) such as paint, lacquer, or varnish, or when intended for use for beauty purposes, the composition 32 may be a cosmetic such as nail varnish, mascara, lipstick, foundation, etc.

The use of the device of the invention is particularly advantageous for a liquid composition presenting viscosity at 25° C. lying in the range 5 mPa·s to 5000 mPa·s, and preferably in the range 20 mPa·s to 4000 mPa·s.

Depending on the nature of the composition 32 contained in the container 10, the device of the invention is used either for coating a solid surface or for coating a region of the human body.

The use of a device of the invention, in particular for applying a cosmetic, more particularly a nail varnish, or a composition for priming the application of a nail varnish, a composition for repairing broken nails, etc., is preferably performed by the following method.

After gripping of the container 10 of the device of the invention, between two adjacent fingers of a first hand M1 of a user, the user uses the other hand M2 to grasp the applicator head 20 by the handle 24 and to apply the composition 32 on at least one nail of the first hand M1.

After unscrewing the handle 24 and extracting the stem 30 of the applicator head 20 from the container 10, the user can apply the composition 32 on the nail for covering by using the applicator head 20.

After applying a first layer of composition on the nail, the user may either move on to another finger of the same hand M1 and continue application on the corresponding nail, or else can decide to move on to a nail of the second hand by passing the container from one hand to the other.

Specifically, and as shown in FIG. 7, the container 10 is wedged between the index and middle fingers 58 and 60 of the left hand M1 of the user, with these two fingers being received in the second constriction 36, while the right hand M2 of the user is holding the applicator head 20 via its handle 24, e.g. using the thumb 57', the index finger 58', and possibly also the middle finger 60' on the right hand.

After applying the composition 32 on the nail 59 of the left index finger 58, if the user finds there remains sufficient composition 32 on the applicator head 20, the user may decide to move on to the following nail 61 of the left middle finger 60 in order to apply the composition 32 thereto.

If the quantity of composition 32 on the applicator head 20 is insufficient, the user dips the head once more into the container 10 in order to load composition 32 onto the applicator head 20. The user can then apply the composition 32 to the nail 61 of the left middle finger 60.

Thereafter, the user may move on to the following nail, e.g. the nail 63 of the left ring finger 62, and then the nail 65 of the middle finger 64, and repeat these operations of loading composition 32 onto the applicator head 20 and applying the composition 32 onto a nail of the left hand M1, or else move the container from one hand to the other so as to start applying the composition 32 on at least one finger of the right hand M2. It can be understood that depending on user preference, the user may prefer to apply the composition 32 to all of the fingers of the left hand M1 and only then change the hand holding the container 10 by passing the container to the right hand M2 in order to apply the composition 32 on the nails of the right hand M2 by using the left hand M1. Naturally, in use, the order left hand then right hand is entirely arbitrary.

Likewise, if applying the composition 32 in a single layer does not suffice, the user may repeat the above-described operations as often as necessary in order to obtain the desired result.

The user may apply composition to all of the nails of the left hand M1, for example, before moving on to the nails of the right hand M2, or on the contrary, if the user prefers changing hands regularly, it is very simple to change hands and thus do some of the nails on one hand and then some of the nails on the other hand, and then return to the first hand, and so on, without there being any need to put the container 10 down on a support.

Likewise, the user may decide always to put the same fingers in the constrictions 34 and 36, specifically the index finger 58, 58' and the middle finger 60, 60', or the user may prefer using different fingers, in particular so as to bring the container 10 closer to the fingers whose nails are receiving the application. Under such circumstances, and if the user prefers finishing application on the nails of one hand before moving on to the other hand, it is very easy to move the position of the container between the fingers of one hand by using the second hand to take hold of the container 10 temporarily for the time required to put it between the desired fingers and grip the container again with the first hand M1.

The user can thus begin by holding the container 10 in the left hand M1, e.g. between the index and middle fingers 58 and 60, and by applying varnish to the nail 59 of the left index finger 58, and then to the nail 61 of the left middle finger 60. Thereafter, the user can take hold of the container 10 with the right hand M2, without putting the container 10 down, by placing two fingers in the second constriction 36, e.g. the right index finger 58' and the right middle finger 60', then letting go with the left hand M1, and positioning, for example, the middle finger 60 and the ring finger 62 of the left hand in the first constriction 34 (still without putting the container 10 down on a support) so as to take hold of the container 10 again in the left hand M1 and let go of it with the right hand M2, and so on.

The container 10 is passed from one hand to the other easily and without putting the container down on a surface, and preferably after putting the applicator head 20 back into the container 10 and optionally, but not necessarily, securing it to the container 10.

What is claimed is:

1. A container for receiving a composition, the container having an annular side wall that extends along a central axis between a bottom and an opening, the side wall presenting a first outside constriction shaped to receive two adjacent fingers, other than the thumb, of a first hand of a user, wherein the side wall also includes a second outside constriction shaped to receive two adjacent fingers, other than the thumb, of a second hand of the same user, the second constriction being spaced apart from the first constriction along the central axis, wherein each of the first and second constrictions is formed by two grooves formed respectively on either side of the container and each extending longitudinally along a longitudinal axis, and wherein the longitudinal axes of the two grooves of each of the first and second constrictions define respective middle axes, the middle axes of the first and second constrictions being angularly offset from each other by an angle lying in the range of 45° to 135° , and preferably in the range of 45° to 120°.

2. A container according to claim 1, wherein each of the first and second constrictions present a minimum diametral width of not more than 2 cm.

3. A container according to claim 1, wherein the first and second constrictions are spaced apart from each other by at least 5 mm along the central axis.

4. A container according to claim 1, wherein the longitudinal axes of the two grooves in each of the first and second constrictions form between them an angle lying in the range 0° to 45° inclusive.

5. A container according to claim 1, wherein each of the first and second constrictions forms a respective angular groove passing all the way around the side wall.

6. A device comprising a container according to claim 1 and an applicator comprising a handle and an applicator head connected to said handle, the handle and the applicator forming a cap for closing the container.

* * * * *